US007726857B2

(12) United States Patent
Nakada et al.

(10) Patent No.: US 7,726,857 B2
(45) Date of Patent: Jun. 1, 2010

(54) LAMP UNIT FOR VEHICLE HEADLAMP

(75) Inventors: Yusuke Nakada, Shizuoka (JP); Michio Tsukamoto, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 243 days.

(21) Appl. No.: 12/062,597

(22) Filed: Apr. 4, 2008

(65) Prior Publication Data

US 2008/0247185 A1 Oct. 9, 2008

(30) Foreign Application Priority Data

Apr. 5, 2007 (JP) ..... 2007-099065

(51) Int. Cl.
*F21V 7/00* (2006.01)

(52) U.S. Cl. ..... 362/518; 362/516; 362/519; 362/517; 362/538; 362/297; 362/307; 362/308

(58) Field of Classification Search ..... 362/516–519, 362/296.01, 296.05, 297, 307–308, 538–539, 362/346, 341

See application file for complete search history.

(56) References Cited

U.S. PATENT DOCUMENTS

| | | | | |
|---|---|---|---|---|
| 4,914,747 | A | 4/1990 | Nino et al. | |
| 2003/0189840 | A1* | 10/2003 | Matsumoto et al. | 362/539 |
| 2005/0094402 | A1 | 5/2005 | Albou | |
| 2006/0209557 | A1* | 9/2006 | Komatsu | 362/539 |
| 2007/0019430 | A1 | 1/2007 | Meyrenaud | |
| 2007/0201241 | A1* | 8/2007 | Komatsu | 362/545 |
| 2007/0236951 | A1 | 10/2007 | Albou | |

FOREIGN PATENT DOCUMENTS

| | | |
|---|---|---|
| JP | 2005-166590 A | 6/2005 |
| JP | 2006-114274 A | 4/2006 |

OTHER PUBLICATIONS

European Search Report issued in European Application No. EP 08 15 4071 mailed on Jun. 26, 2008, 6 pages.

* cited by examiner

*Primary Examiner*—Jong-Suk (James) Lee
*Assistant Examiner*—Robert J May
(74) *Attorney, Agent, or Firm*—Osha • Liang LLP

(57) ABSTRACT

A lamp unit for a headlamp of a vehicle includes a projection lens, a light emitting device disposed on a rear side of the projection lens, a reflector, and a mirror member having an upwardly reflecting surface. The reflector forwardly reflects light from the light emitting device toward an optical axis, and the upwardly reflecting surface upwardly reflects part of the light reflected by the reflector. The upwardly reflecting surface includes a first horizontal surface disposed on a self-lane side of the optical axis, a second horizontal surface disposed on an opposing-lane side of the optical axis, and an intermediate slope surface connecting the first and second horizontal surfaces. The intermediate slope surface includes a front slope surface and a rear slope surface on the rear side of the front slope surface, and the rear slope surface is curved.

16 Claims, 9 Drawing Sheets

LAMP UNIT FOR VEHICLE HEADLAMP

BACKGROUND OF INVENTION

1. Field of the Invention

The present invention relates to a lamp unit for a vehicle headlamp, and more particularly, to a projector-type lamp unit which uses a light emitting device as a light source.

2. Background Art

In recent years, related art lamp units having a light emitting device as a light source, e.g., a light emitting diode, are increasingly being used in lamps such as vehicle headlamps.

For example, a related art projector-type lamp unit includes a projection lens disposed on an optical axis extending in a front-and-rear direction of a vehicle, a light emitting device disposed on a rear side of a rear focal point of the projection lens near the optical axis such that the light emitting device is oriented upward, and a reflector disposed to cover an upper side of the light emitting device to forwardly reflect light emitted from the light emitting device toward the optical axis (see, e.g., JP 2005-166590 A).

Such a lamp unit further includes a mirror member having an upwardly reflecting surface which upwardly reflects part of the light reflected from the reflector. The mirror member is disposed between the reflector and the projector lens such that a front edge of the upwardly reflecting surface passes through the rear focal point of the projection lens. The lamp unit is configured to form a low-beam light distribution pattern having a cutoff line along an upper edge thereof. The cutoff line is form as an inverted projection image of the front edge of the upwardly reflecting surface.

Another related art projector-type lamp unit includes a similar upwardly reflecting surface having a first horizontal surface extending on a self-lane side from an optical axis, an intermediate slope surface extending obliquely downward on an opposing-lane side from the optical axis, and a second horizontal surface extending on the opposing-lane side from a lower edge of the intermediate slope surface so as to be parallel to the first horizontal surface (see, e.g., JP 2006-114274 A).

By employing projector-type lamp units having the mirror member as described above, it is possible to increase a light flux utilization ratio for the light emitted from the light emitting device and, furthermore, to form the low-beam light distribution pattern with a clear cutoff line at the upper edge thereof.

Further, with the configuration in which the upper reflecting surface of the mirror member includes the first horizontal surface, the intermediate slope surface and the second horizontal surface as disclosed in JP 2006-114274 A, it is possible to form the low-beam light distribution pattern with a cutoff line having a opposing-lane cutoff line, a self-lane cutoff line extending at a level higher than the opposing-lane, and an oblique cutoff line connecting, on the self-lane side, the opposing-lane cutoff line and the self-lane cutoff line.

However, light reflected from the intermediate slope surface obliquely forms a light distribution pattern such that it partially overlaps with a light distribution pattern form by the second horizontal surface such that a dark portion is created between the light distribution pattern formed by the light reflected from the intermediate slope surface and a light distribution pattern formed by a light reflected from the first horizontal surface. Thus, the light distribution pattern formed by the light reflected from the mirror member tends to cause an unevenness of the low-beam light distribution pattern.

SUMMARY OF INVENTION

One or more exemplary embodiments of the present invention provide a lamp unit configured to form, with a light emitting device being used as a light source, a low-beam light distribution pattern having a stepped cutoff line, while suppressing an unevenness of the light distribution pattern.

According to one or more exemplary embodiments of the present invention, a lamp unit for a headlamp of a vehicle is provided. The lamp unit includes a projection lens disposed on an optical axis of the lamp unit, a light emitting device disposed on a rear side of a rear focal point of the projection lens, a reflector disposed so as to cover an upper side of the light emitting device, and a mirror member having an upwardly reflecting surface arranged between the reflector and the projection lens such that a front edge of the upwardly reflecting surface passes through the rear focal point of the projection lens. The reflector forwardly reflects light from the light emitting device toward the optical axis, and the upwardly reflecting surface upwardly reflects part of the light reflected by the reflector. The upwardly reflecting surface includes a first horizontal surface disposed on a self-lane side of the optical axis, a second horizontal surface disposed on an opposing-lane side of the optical axis, the second horizontal surface being parallel to the first horizontal surface and lower than the first horizontal surface, and an intermediate slope surface connecting the first horizontal surface and the second horizontal surface. The intermediate slope surface includes a front slope surface rearwardly extending from a portion of the front edge of the upwardly reflecting surface, and a rear slope surface rearwardly extending from a rear end of the front slope surface. The rear slope surface is curved such that a virtual edge extending rearward from a boundary between the first horizontal surface and the front slope surface at the front edge of the intermediate slope surface is rounded.

Other aspects and advantages of the invention will be apparent from the following description, the drawings and the claims.

DETAILED DESCRIPTION

Hereinafter, exemplary embodiments of the present invention will be described with reference to the drawings.

First Exemplary Embodiment

A first exemplary embodiment of the present invention will be described below with reference to FIGS. 1 to 8.

Figure 1:
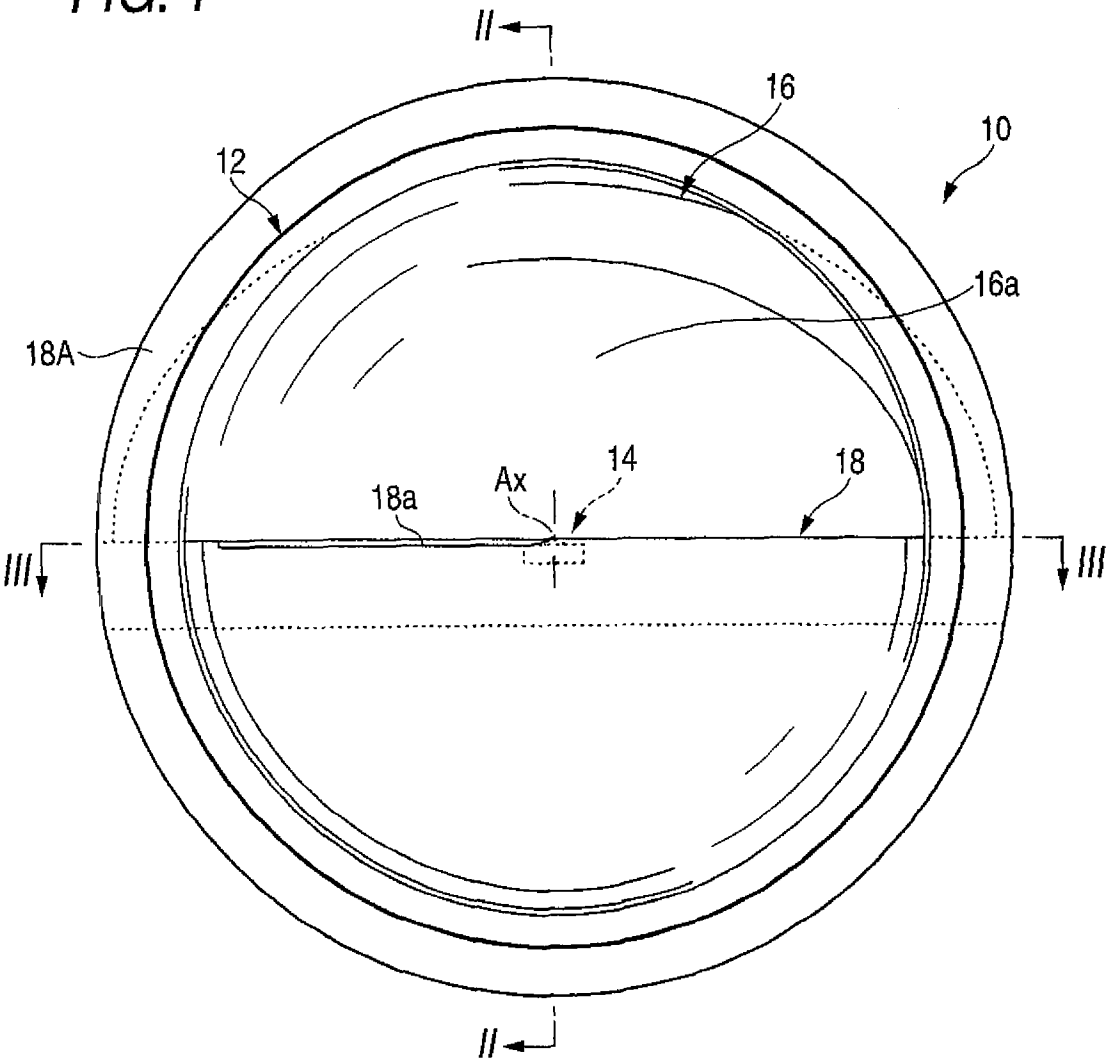
FIG. 1 is a front view showing a lamp unit according to one or more exemplary embodiments of the present invention.
Figure 2:
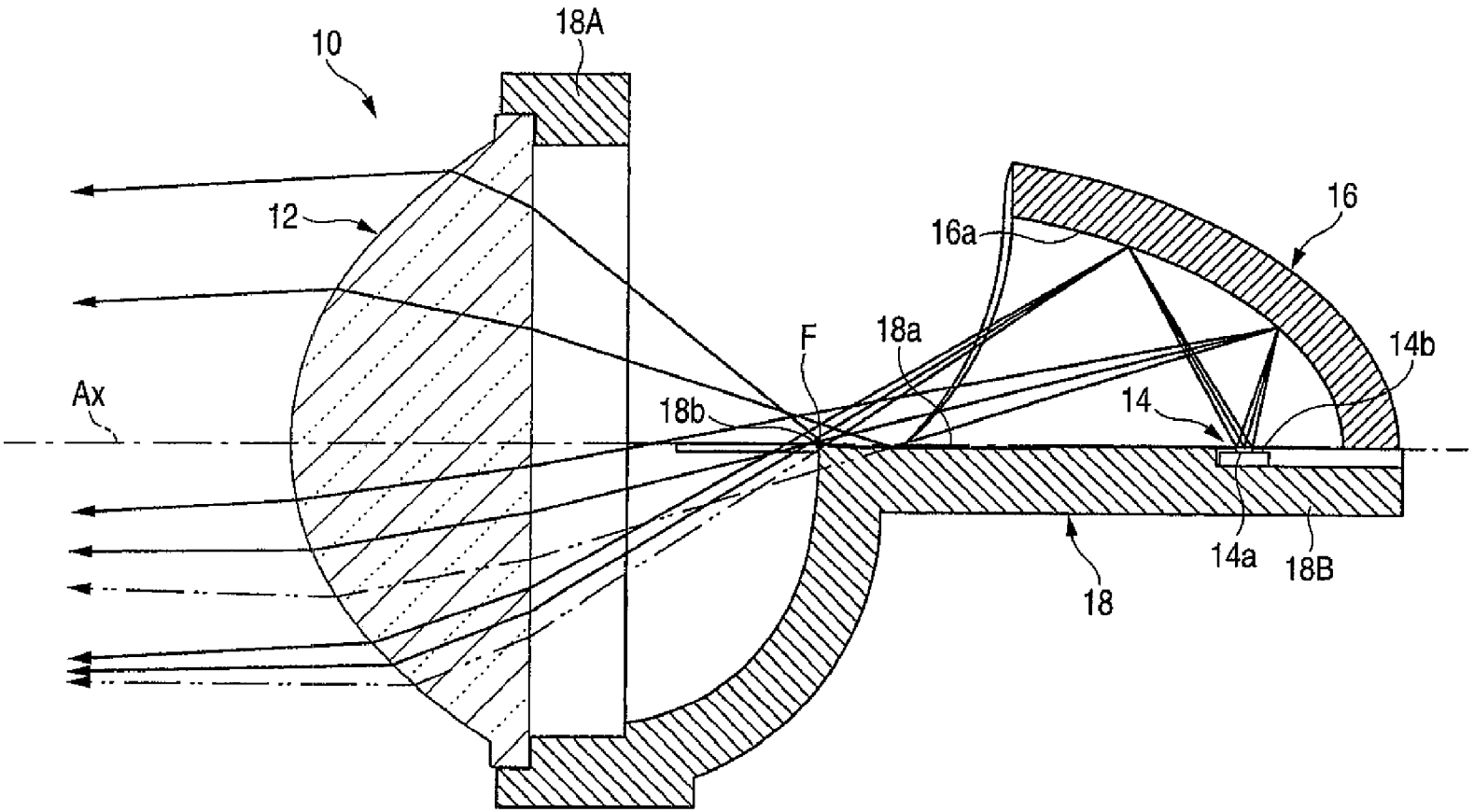
FIG. 2 is a sectional view taken along the line II-II in FIG. 1.
Figure 3:
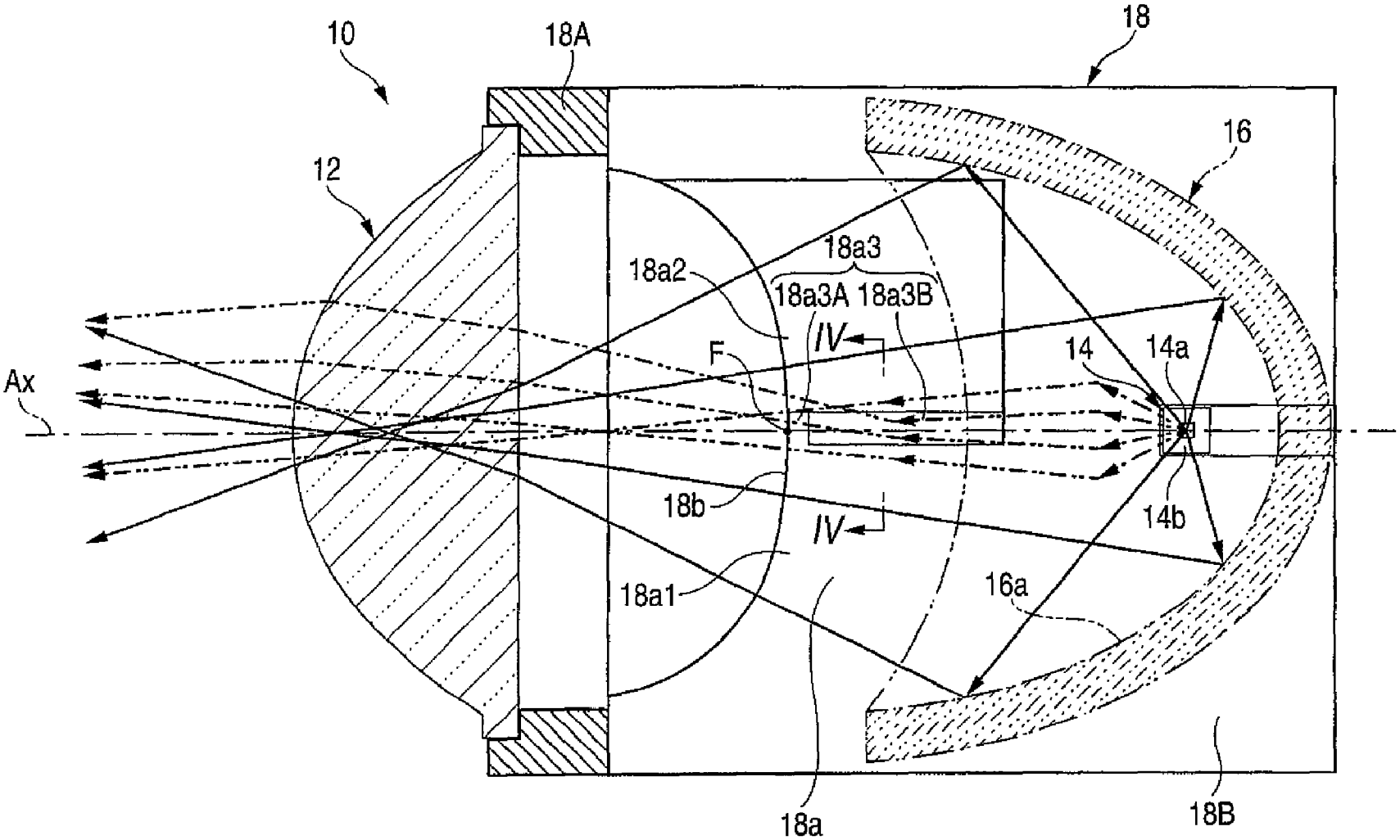
FIG. 3 is a sectional view taken along the line III-III in FIG. 1.

As shown in FIGS. 1 to 3, a lamp unit 10 includes a projection lens 12 disposed on an optical axis Ax extending substantially in a front-and-rear direction of a vehicle, a light emitting device 14 disposed on a rear side of a rear focal point F of the projection lens 12, a reflector 16 disposed to cover an upper side of the light emitting device 14 to forwardly reflect light emitted from the light emitting device 14 toward the optical axis Ax, and a mirror member 18 disposed between the reflector 16 and the projection lens 12 to upwardly reflect part of the light reflected from the reflector 16.

The lamp unit 10 is adapted to be incorporated into a vehicle headlamp as a part of the vehicle headlamp. The lamp unit 10 may be configured such that when it is incorporated in to the vehicle headlamp, the optical axis Ax thereof extends in a downward direction with respect to front-and-rear direction of the vehicle by about 0.5 degrees to about 0.6 degrees. Although the lamp unit 10 according to the first exemplary embodiment is configured to form a low-beam light distribution pattern for left-hand traffic, it is apparent that the lamp unit may also be configured to be adapted to right-hand traffic.

The projection lens 12 is a plano-convex lens having a convex front surface and a flat rear surface. The projection lens 12 is configured to project a light source image on a rear focal plane, i.e., a surface including the rear focal point F, onto a virtual vertical screen in front of the lamp unit 10 as an inverted image. The mirror member 18 includes a ring-shaped lens holder 18A to which the projection lens 12 is attached and fixed, and a rearwardly extended portion 18B.

The light emitting device 14 may be any kind in so far as it has a light emitting surface from which light can be emitted in a form that is close to a point light. For example, the light emitting device 14 may be a light emitting diode or a laser diode. In the first exemplary embodiment, the light emitting device 14 is a white light emitting diode having a light emitting chip 14*a*, and a substrate 14*b* on which the light emitting chip 14*a* is supported. The light emitting chip 14*a* has a square light emitting surface, a dimension of which being about 1 mm by 1 mm. The light emitting chip 14*a* is hermetically disposed inside a thin film covering the light emitting surface. The light emitting device 14 may be disposed on or near the optical axis Ax, and may be oriented such that the light emitting surface thereof faces upward. In the first exemplary embodiment, the light emitting device 14 is disposed on the optical axis, and is oriented such that the light emitting surface thereof faces vertically upward. The light emitting device 14 is positioned and fixed in a recessed portion formed on an upper portion of the rearwardly extended portion 18B of the mirror member 18.

A reflecting surface 16*a* of the reflector 16 is formed as an ellipsoidal curved surface, a major axis of which is coincident with the optical axis Ax and a first focal point of which is coincident with a light emitting center of the light emitting device 14. An eccentricity of the ellipsoidal curved surface gradually increases from a vertical section toward a horizontal section. In the vertical section, the reflecting surface 16*a* converges light emitted from the light emitting device 14 at a point slightly in front of the rear focal point F of the projection lens 12. In the horizontal section, the reflecting surface 16*a* converges light emitted from the light emitting device 14 at another point farther in front of the rear focal point F than in the vertical section. The reflector 16 is fixed to the upper portion of the rearwardly extended portion 18B at a lower end portion of the reflecting surface 16*a*.

The mirror member 18 further includes a plate-shaped portion extending in a horizontal direction, and an upwardly reflecting surface 18*a* formed on an upper surface of the plate-shaped portion. The upwardly reflecting surface 18*a* extends rearward along the optical axis Ax from the rear focal point F. The upwardly reflecting surface 18*a* upwardly reflects part of the light reflected from the reflector 16. The upwardly reflecting surface 18*a* may be formed by a mirror finishing treatment such as an aluminum deposition on the upper surface plate-shaped portion.

A front edge 18*b* of the upwardly reflecting surface 18*a* is configured and positioned so as to extend along the rear focal plane of the projection lens 12. More specifically, the front edge 18*b* is curved to be gradually displaced forward from the rear focal point F as it extends sidewardly away from the optical axis Ax when seen in the horizontal section.

The upwardly reflecting surface 18*a* includes a first horizontal surface 18*a*1 disposed on a self-lane side of the optical axis Ax, i.e., a left side (or a right side when seen from a front side of the lamp unit 10) of the optical axis Ax, a second horizontal surface 18*a*2 disposed on an opposing-lane side, i.e., a right side, of the optical axis Ax so as to be lower than the first horizontal surface 18*a*1, and an intermediate slope surface 18*a*3 extending obliquely downward from the first horizontal surface 18*a*1 to connect the first horizontal surface 18*a*1 and the second horizontal surface 18*a*2. A portion behind the second horizontal surface 18*a*2 including the rearwardly extended portion 18B is on a same plane as the first horizontal surface 18*a*1. In the first exemplary embodiment, a downward inclination angle of the intermediate slope surface 18*a*3 is about 15 degrees with respect to the first horizontal surface 18*a*1, and the second horizontal surface 18*a*2 is positioned lower than the first horizontal surface 18*a*1 by about 0.4 mm.

Figure 4:
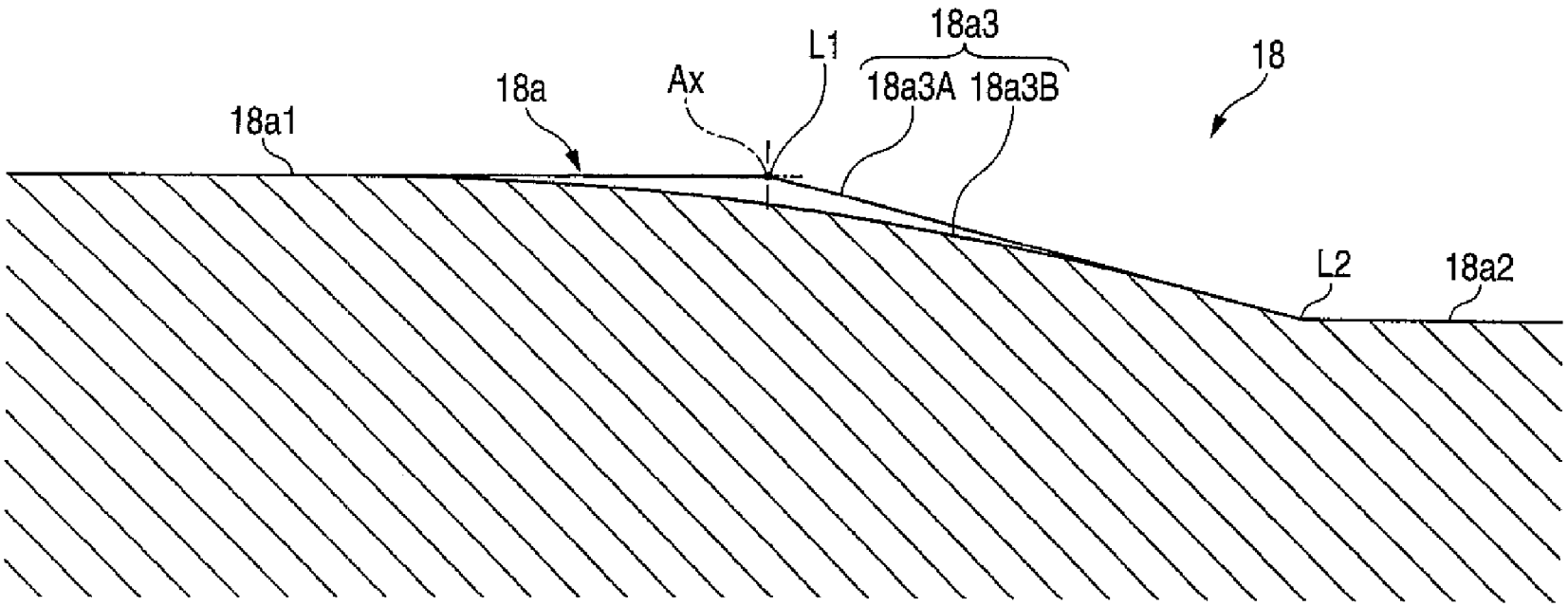
FIG. 4 is a detailed sectional view taken along the line IV-IV in FIG. 3.
Figure 5:
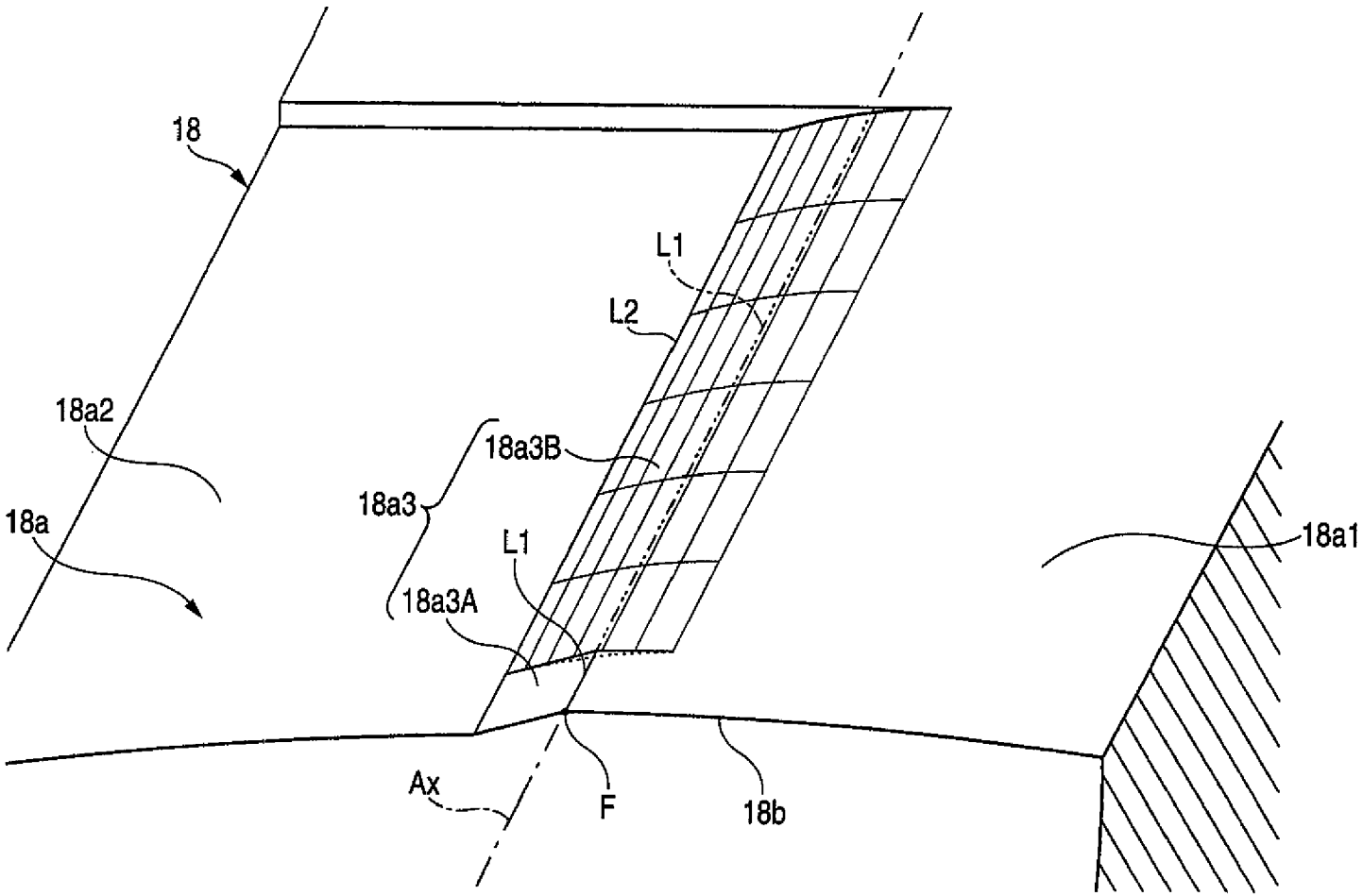
FIG. 5 is a perspective view of a part of a mirror member according to a first exemplary embodiment of the present invention.

FIG. 4 is a sectional view taken along the line IV-IV in FIG. 3, and FIG. 5 is a perspective view showing a part of the mirror member 18.

As shown in FIGS. 4 and 5, the intermediate slope surface 18*a*3 includes a front slope surface 18*a*3A rearwardly extending from a part of the front edge 18*b*, and a rear slope surface 18*a*3B rearwardly extending from a rear end of the front slope surface 18*a*3A. The rear slope surface 18*a*3B is a curved surface having such a shape that a virtual edge extending rearward from a ridge line L1, which is a boundary between the first horizontal surface 18*a*1 and the front slope surface 18*a*3A, is rounded.

However, the rear slope surface 18*a*3B may be designed to have any range as long as it is disposed behind the front edge 18*b* with a certain interval. In the first exemplary embodiment a front end of the rear slope surface 18*a*3B is about 1 mm to about 4 mm (e.g., 2 mm) behind the rear focal point F, and a rear end of the rear slope surface 18*a*3B is about 15 mm to about 25 mm behind the rear focal point F (e.g., 20 mm).

A section of the rear slope surface 18*a*3B may be constant or non-constant, e.g., gradually varying, along the optical axis Ax. In the first exemplary embodiment, the section of the rear slope surface 18*a*3B may be constant along the optical axis Ax. More specifically, the rear slope surface 18*a*3B is a cylindrical curved surface having a radius about 80 mm to about 100 mm (e.g., 90 mm) along the optical axis Ax.

Along a valley line L2, which is a boundary between the second horizontal surface 18*a*2 and the intermediate slope surface 18*a*3, the rear slope surface 18*a*3B meets the second horizontal surface 18*a*2 at a downward inclination angle of about 15 degrees, while a left side end of the rear slope surface 18*a*3B is smoothly connected to the first horizontal surface 18*a*1 such that the cylindrical curved surface extends across the optical axis Ax toward the first horizontal surface 18*a*1. In FIG. 5, the rear slope surface 18*a*3B is meshed in order to illustrate the cylindrical curved surface.

On the other hand, the ridge line L1 in front of the rear slope surface 18*a*3B is not rounded. More specifically, the front slope surface 18*a*3A is a flat surface extending obliquely downward from the optical axis Ax at a downward inclination angle of about 15 degrees.

As shown in FIGS. 2 and 3, the light emitted from the light emitting device 14 is forwardly reflected by the reflecting surface 16*a* of the reflector 16 toward the optical axis Ax, and part of the light becomes incident on a lower portion of the projection lens 12, while another part of the light is reflected by the upwardly reflecting surface 18*a* and becomes incident on an upper portion of the projection lens 12. Both the lower and upper portions of the projection lens 12 transmits the light such that the light is downwardly irradiated in a forward direction from the projection lens 12.

The light which is incident on the intermediate slope surface 18*a*3 of the upwardly reflecting surface 18*a* from the reflector 16 is reflected in a rightward direction because the intermediate slope surface 18*a*3 extends obliquely downward to the right from the optical axis Ax.

A rightward deflection angle of the light reflected by the front slope surface 18*a*3A is constant at any point on which the light is incident from the reflector 16 because the front slope surface 18*a*3A is the flat surface which is downwardly inclined at about 15 degrees. On the other hand, a rightward deflection angle of the light reflected by the rear slope surface 18*a*3B varies depending on a point on which the light is incident from the reflector 16 because the rear slope surface 18*a*3B includes the cylindrical curved surface. More specifically, the rightward deflection angle is small at a point near the left side end of the rear slope surface 18*a*3B, and it becomes gradually large toward the right side end of the rear slope surface 18*a*3B.

Figure 6:
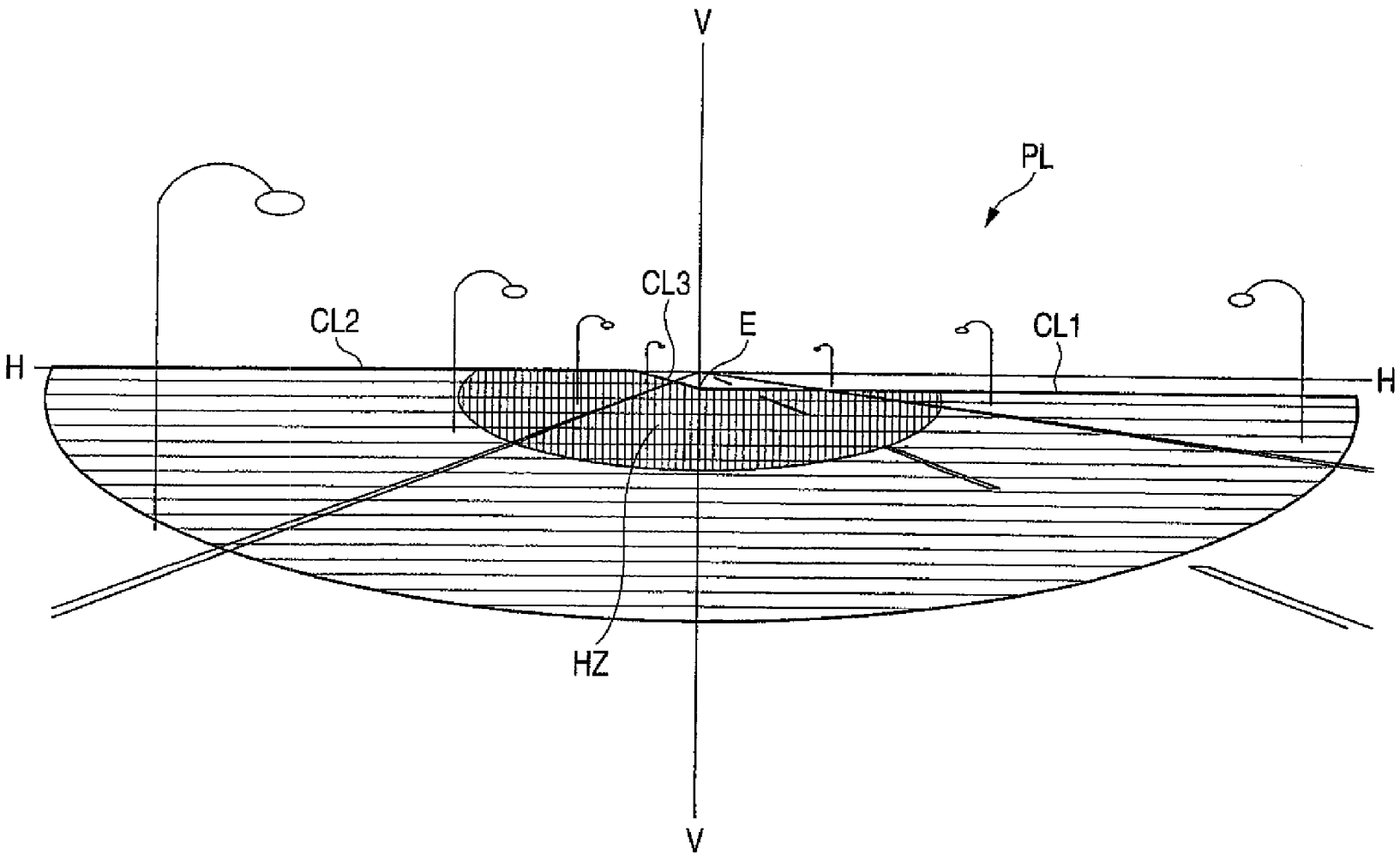
FIG. 6 is a perspective view showing a low-beam light distribution pattern which is formed, on a virtual vertical screen disposed 25 m in front of a vehicle, by light irradiated from the lamp unit.

FIG. 6 is a perspective view showing a low-beam light distribution pattern PL formed, on a virtual vertical screen disposed 25 m in front of the vehicle, by the light forwardly irradiated from the lamp unit 10 according to the first exemplary embodiment.

As shown in FIG. 6, the low-bean light distribution pattern PL is for the left-hand traffic, and includes stepped cutoff lines CL1, CL2, CL3 along an upper edge thereof.

More specifically, the cutoff line CL1 extends in a horizontal direction on the right side, i.e., the opposing-lane side, of a line V-V which passes through a vanishing point H-V in a forward direction of the lamp unit 10, while the cutoff line CL2 extends in the horizontal direction on the left side, i.e., the self-lane side, of the line V-V at a level higher than the cutoff line CL1. The oblique cutoff line CL3 extends from an intersection point of the cutoff line CL1 and the line V-V to an end of the cutoff line CL2 on a side of the line V-V at an upward inclination angle of about 15 degrees with respect to the cutoff line CL1.

In the low-beam light distribution pattern PL, an elbow point E, which is the intersection point of the lower cutoff line CL1 and the line V-V, is positioned about 0.5 degrees to about 0.6 degrees downward from the point H-V. This is because the optical axis Ax extends in direction about 0.5 degrees to about 0.6 degrees downward with respect to the front-and-rear direction of the vehicle. In the low-beam light distribution pattern PL, a hot zone HZ, which is a region having a high luminous intensity, is formed so as to surround the elbow point E.

The low-beam light distribution pattern PL is formed by projecting an image of the light emitting device 14, which is formed on the rear focal plane of the projection lens 12 with the light emitted from the light emitting device 14 and reflected by the reflector 16, as an inverted projection image on the virtual vertical screen through the projection lens 12. The cutoff lines CL1, CL2, CL3 are formed as an inverted projection image of the front edge 18*b* of the upwardly reflecting surface 18*a* of the mirror member 18.

The low-beam light distribution pattern PL is a combined light distribution pattern of a light distribution pattern formed by the light which is directly incident on the lower portion of the projection lens 12 from the reflector 16 and is part of the light emitted from the light emitting device 14 and reflected by the reflecting surface 16*a* of the reflector 16, and another light distribution pattern formed by the light which is incident on an upper portion of the projection lens 12 from the upwardly reflecting surface 18*a* of the mirror member 18 and is another part of the light emitted from the light emitting device 14 and reflected by the reflecting surface 16*a* of the reflector 16.

Figure 7:
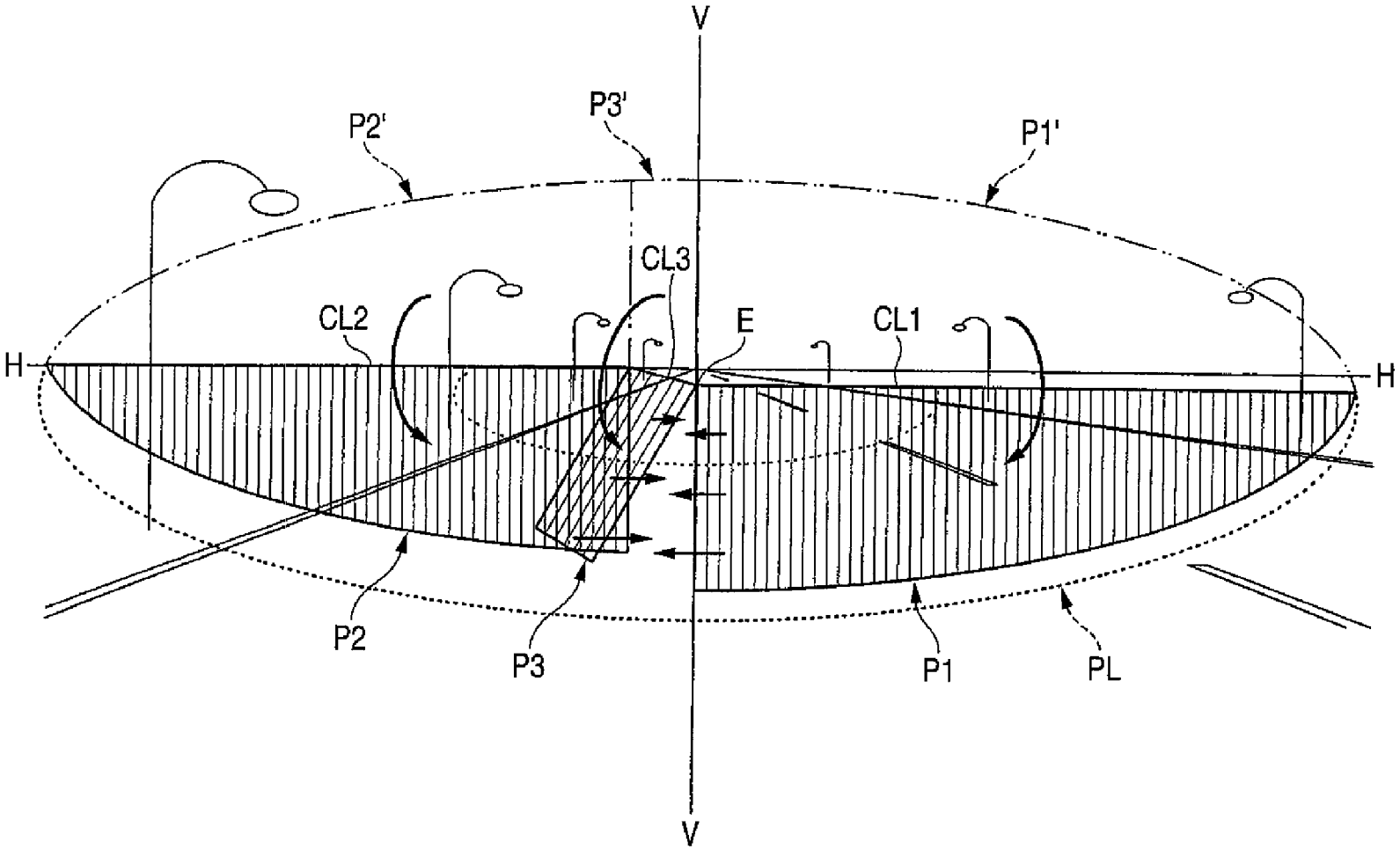
FIG. 7 is perspective view showing three light distribution patterns which are included in the low-beam light distribution pattern, and are formed by light that is incident on an upper portion of a projection lens from an upwardly reflecting surface of the mirror member.

FIG. 7 is a perspective view showing three light distribution patterns P1, P2, P3 which are included in the low-beam light distribution pattern PL, and are formed by the light that is incident on the upper portion of the projection lens 12 from the upwardly reflecting surface 18*a* of the mirror member 18.

More specifically, the light distribution pattern P1 is formed by light reflected by the first horizontal surface 18*a*1 of the upwardly reflecting surface 18*a*, the light distribution pattern P2 is formed by a light reflected by the second horizontal surface 18*a*2, and the light distribution pattern P3 is formed by a light reflected by the intermediate slope surface 18*a*3. However, the three light distribution patterns P1, P2, P3 illustrated in FIG. 7 are light distribution patterns that are formed in a case where the ridge line L1 exists in a boundary between the rear slope surface 18*a*3B and the first horizontal surface 18*a*1, i.e., in a case where the virtual edge extending rearward from the ridge line L1 is not rounded.

FIG. 7 also illustrates three light distribution patterns P1', P2', P3' in a two-dotted chain line. These light distribution patterns P1', P2', P3' are light distribution patterns that are formed by the light which is not reflected by the first horizontal surface 18*a*1, the second horizontal surface 18*a*2, and the intermediate slope surface 18*a*3, but are directly incident on the lower portion of the projection lens 12 assuming that the mirror member 18 is not provided. The light distribution patterns P1', P2', P3' are formed on an upper side of the cutoff lines CL1, CL2, CL3.

The light distribution pattern P1 is obtained by vertically inverting the light distribution pattern P1', which is positioned above the opposing-lane side cutoff line CL1, with respect to the opposing-lane side cutoff line CL1. Similarly, the light distribution pattern P2 is obtained by vertically inventing the light distribution pattern P2', which is positioned above the self-lane side cutoff line CL2, with respect to the self-lane side cutoff line CL2, and the light distribution pattern P3 is obtained by vertically inverting the light distribution pattern P3', which is positioned above the oblique cutoff line CL3, with respect to the oblique cutoff line CL3.

Because the oblique cutoff line CL3 extends at the upward inclination angle of about 15 degrees toward the left the light distribution pattern P3 is formed so as to be separated from the light distribution pattern P1 on the right side and to partially overlap with the light distribution pattern P2 on the left side.

Accordingly, a gap between the light distribution pattern P1 and the light distribution pattern P3 becomes a dark portion, whereas an area adjacent to the dark portion becomes a bright portion in which the light distribution pattern P2 and the light distribution pattern P3 overlap with each other. Therefore, unevenness is generated in a light distribution in a short distance region of the road surface in front of the vehicle.

However, according to the lamp unit 10 of the first exemplary embodiment, because the virtual edge extending rearward from the ridge line L1 is rounded, the light distribution pattern P3 formed by the light reflected from the intermediate slope surface 18*a*3 and the light distribution pattern P1 formed by the light reflected from the first horizontal surface 18*a*1 are smoothly connected to each other except for an area around the upper edges thereof. Therefore, it is possible to reduce the unevenness of the light distribution in the short distance region of the road surface in front of the vehicle as compared with the case in which the ridge line L1 exists between the rear slope surface 18*a*3B and the first horizontal surface 18*a*1 without being rounded.

As described above, the lamp unit 10 of the first exemplary embodiment is configured as a projector-type with the light emitting device 14 being used as a light source. The mirror member 18 having the upwardly reflecting surface 18*a*, which upwardly reflects a part of the light reflected from the reflector 16, is disposed between the reflector 16 and the projection lens 12. The front edge 18*b* of the upwardly reflecting surface 18*a* is formed to pass through the rear focal point F of the projection lens 12. Therefore, it is possible to enhance a luminous flux utilization ratio of the light emitted from the light emitting device 14, and to form the low-beam light distribution pattern PL having the clear cutoff lines CL1, CL2, CL3 at the upper edge thereof.

The upwardly reflecting surface 18*a* includes the first horizontal surface 18*a*1 on the self-lane side, the first horizontal surface 18*a*1 including a part of the optical axis Ax, the intermediate slope surface 18*a*3 obliquely extending downward toward the opposing-lane side of the optical axis Ax, and the second horizontal surface 18*a*2 extending from the lower side edge of the intermediate slope surface 18*a*3 so as to be parallel to the first horizontal surface 18*a*1. The rear slope surface 18*a*3B of the intermediate slope surface 18*a*3, which is positioned on the rear side of the front edge 18*b* with a certain interval therebetween, includes such a curved surface that the virtual edge extending rearward along the ridge line L1, which is the boundary between the first horizontal surface 18*a*1 and the front slope surface 18*a*3A, is rounded. Therefore, it is possible to obtain one or more of the following advantages.

In a case where the ridge line L1 exists in the entire boundary between the first horizontal surface 18*a*1 and the intermediate slope surface 18*a*3 without being rounded, the light distribution pattern P3, which is obliquely formed by the light reflected by the intermediate slope surface 18*a*3, partially overlaps with the light distribution pattern P2 formed by the light reflected from the second horizontal surface 18*a* and creates a dark portion between the light distribution pattern P3 and the light distribution pattern P1 formed by the light reflected from the first horizontal surface 18*a*1. However, because the rear slope surface 18*a*3B includes the cylindrical curved surface along substantially the entire width thereof such that the virtual edge extending rearward from the ridge line L1 is rounded, most of the light distribution pattern P3 formed by the light reflected by the intermediate slope surface 18*a*3 is formed so as to be smoothly connected to the light distribution pattern P1 formed by the light reflected by the first horizontal surface 18*a*1. Accordingly, it is possible to reduce a possibility that unevenness of the light distribution is generated in the low-beam light distribution pattern PL due to the light distribution patterns P1, P2, P3 formed by the lights reflected by the upwardly reflecting surface 18*a*.

Further, the front edge 18*b* of the upwardly reflecting surface 18*a* is not rounded at a point on the ridge line L1. Therefore, it is possible to suppress the generation of the light distribution unevenness without hindering the clear formation of the cutoff lines CL1, CL2, CL3.

Thus, it is possible to suppress the generation of the light distribution unevenness in the projector-type lamp unit 10 configured to form the low-beam light distribution patterns having the stepped cutoff lines CL1, CL2, CL3 with the light emitting device 14 being used as the light source.

When the front side end of the rear slope surface 18*a*3B is positioned about 1 mm to about 4 mm behind the rear focal point F of the projection lens 12, and the rear side end of the rear slope surface 18*a*3B is positioned about 15 mm to about 25 mm behind the rear focal point F, it is possible to diffuse a light to be irradiated toward a relatively short distance region of the road surface in front of the vehicle (i.e., a region where the light distribution unevenness is remarkable), thereby effectively suppressing the generation of the light distribution unevenness. Moreover, the ridge line L1 is maintained in the boundary between the first horizontal surface 18*a*1 and the front slope surface 18*a*3A in front of the rear slope surface 18*a*3B. Therefore, it is possible to easily form the shape of the front edge 18*b* of the upwardly reflecting surface 18*a* with high dimensional precision. Consequently, it is possible to clearly form the cutoff lines CL1, CL2, CL3 by the front edge 18*b* of the upwardly reflecting surface 18*a*, while suppressing the generation of the light distribution unevenness.

In the first exemplary embodiment, the rear slope surface 18*a*3B includes the cylindrical curved surface along substantially the entire width thereof such that the virtual edge extending rearward from the ridge line L1 is rounded. However, the light distribution pattern P3 formed by the light reflected from the intermediate slope surface 18*a*3 can be formed so as to be smoothly connected to the light distribution pattern P1 formed by the light reflected from the first horizontal surface 18*a*1 even if the curved surface of the rear slope surface 18*a*3B has a different configuration.

In the first exemplary embodiment, the downward inclination angle of the intermediate slope surface 18*a*3 is about 15 degrees. However, a similar advantages can be obtained with a different downward inclination angle of the intermediate slope surface 18*a*3 in so far as the rear slope surface 18*a*3B includes such a curved surface that the virtual edge extending rearward from the ridge line L1 is rounded.

In the first exemplary embodiment, the light emitting surface of the light emitting chip 14*a* of the light emitting device 14 is about 1 mm square. However, the light emitting surface of the light emitting chip 14*a* may have different shapes or sizes. Further, the lamp unit 10 may include a plurality of light emitting chips 14*a* which are disposed adjacent to each other.

In the first exemplary embodiment, the upwardly reflecting surface 18*a* is formed so as to rearwardly extend along the optical axis Ax from the rear focal point F. However, the upwardly reflecting surface 18*a* may be formed such that it is slightly inclined toward the front (e.g., about 1.5 degrees) with respect to the front-and-rear direction of the vehicle. According to such a configuration, it is possible to easily pull out a metal mold when molding the mirror member 18. In addition, it is possible increase an amount of light incident on the projection lens 12 from the upwardly reflecting surface 18*a*.

Hereinafter, other exemplary embodiments will be described in which the mirror member 18 of the first exemplary embodiment is modified.

Second Exemplary Embodiment

Figure 8:
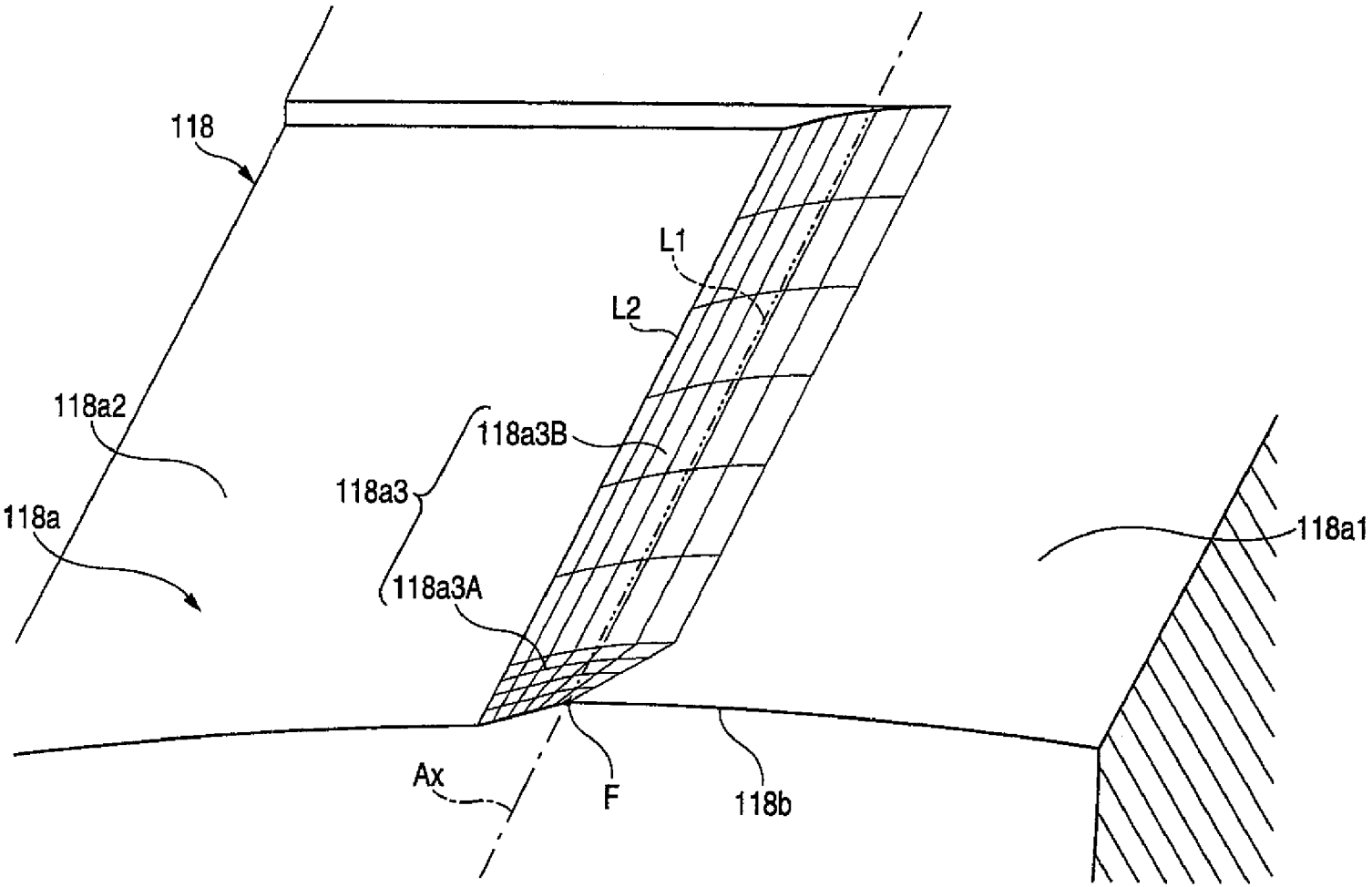
FIG. 8 is a perspective view of a part of a mirror member according to a second exemplary embodiment.

FIG. 8 is a perspective view of a mirror member 118 according to a second exemplary embodiment of the present invention.

As shown in FIG. 8, an upwardly reflecting surface 118*a* of the mirror member 118 includes a first horizontal surface 118*a*1, a second horizontal surface 118*a*2, and an intermediate slope surface 118*a*3 which are disposed in a similar manner as in the mirror member 18 of the first exemplary embodiment. However, a configuration of a front slope surface 118*a*3A of the intermediate slope surface 118*a*3 is different from that in the first exemplary embodiment.

More specifically, while the mirror member 18 of the first exemplary embodiment is configured such that the front slope surface 18*a*3A of the intermediate slope surface 18*a*3 of the upwardly reflecting surface 18*a* is a flat surface having a downward inclination angle of 15 about degrees with respect to the first horizontal surface 18*a*1, the mirror member 118 of the second exemplary embodiment is configured such that the front slope surface 118*a*3A of the intermediate slope surface 118*a*3 is a curved surface having a sectional shape which gradually varies from a front-viewed shape of a front edge 118*b* of the upwardly reflecting surface 118*a* to a sectional shape taken along a plane orthogonal to an optical axis Ax at a front side end of a rear slope surface 118*a*3B. The front slope surface 118A extends in a fan-shaped form on the self-lane side of the optical axis Ax, and is smoothly connected to the first horizontal surface 118*a*1 at a left side end thereof. In FIG. 8, the front slope surface 118*a*3A is also meshed in order to illustrate the shape of the gradually changing curved surface.

According to the configuration of the second exemplary embodiment in addition to the light distribution pattern formed by the light reflected from the rear slope surface 118*a*3B, a light distribution pattern formed by a light reflected from the front slope surface 118*a*3A can also be formed so as to be smoothly connected to the light distribution pattern P1 formed by the light reflected from the first horizontal surface 118*a*1. Consequently, it is possible to suppress the generation of the light distribution unevenness more effectively. Moreover, while a wall surface exists at the front side end of the rear slope surface 18*a*3B and blocks a part of the light reflected from the rear slope surface 18*a*3B in the first exemplary embodiment, such a wall surface does not exist in the second exemplary embodiment because the front slope surface 118*a*3A and the rear slope surface 118*a*3B are contiguously connected. Thus, it is possible to more effectively utilize a luminous flux of the light source.

In the second exemplary embodiment the front slope surface 118*a*3A of the intermediate slope surface 118*a*3 is smoothly connected to the first horizontal surface 118*a*1 at the left side end thereof. However, even if the front slope surface 118*a*3A is not smoothly connected to the first horizontal surface 118*a*1, the light distribution pattern formed by the light reflected from the front slope surface 118*a*3A can be made closer to the light distribution pattern P1 formed by the light reflected from the first horizontal surface 118*a*1. Therefore, it is still possible to suppress the generation of the light distribution unevenness as compared with the related art.

Third Exemplary Embodiment

Figure 9:
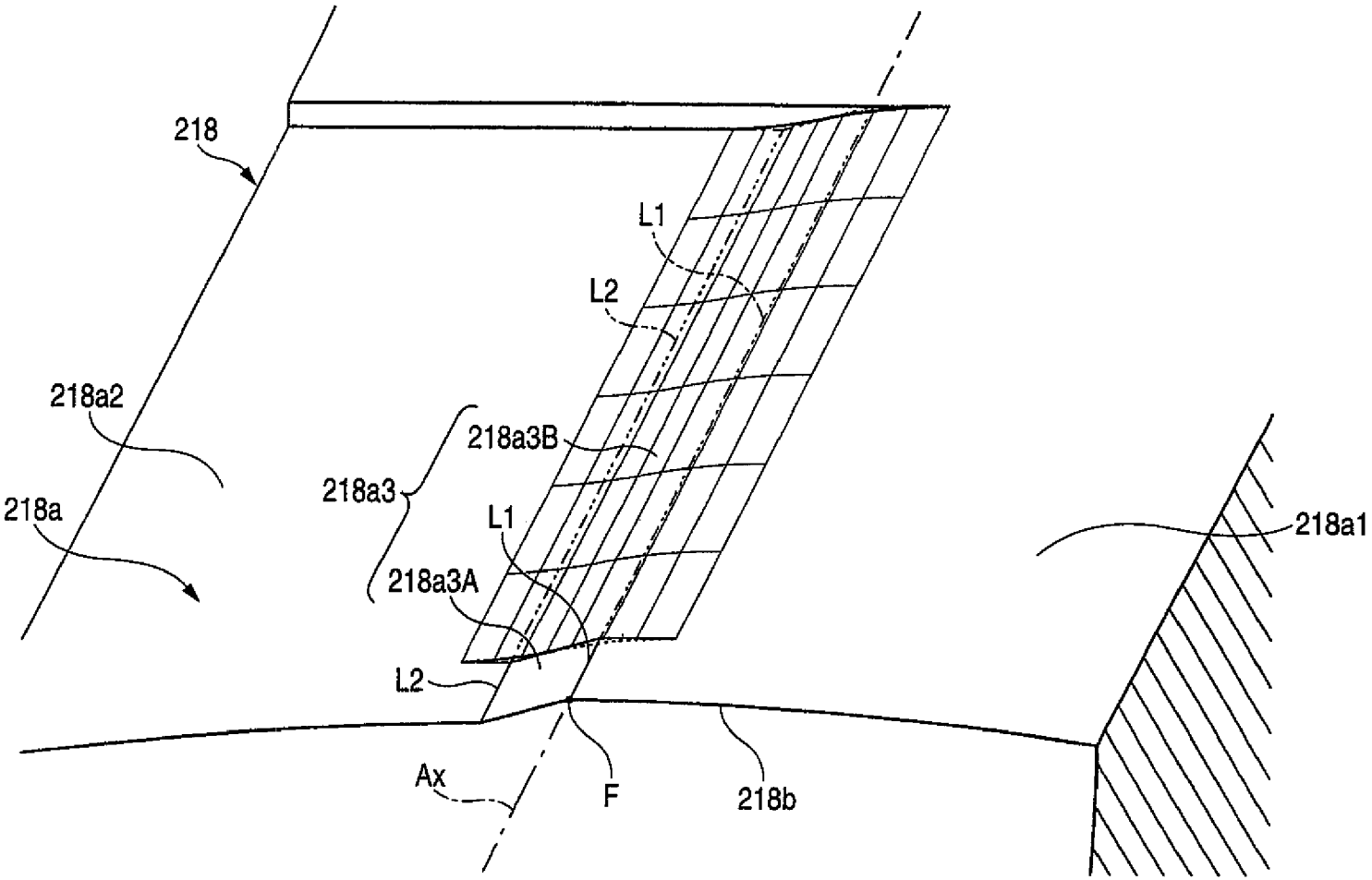
FIG. 9 is a perspective view of a part of a mirror member according to a third exemplary embodiment.

FIG. 9 is a perspective view of a mirror member 218 according to a third exemplary embodiment of the present invention.

As shown in FIG. 9, an upwardly reflecting surface 218*a* of the mirror member 218 includes a first horizontal surface 218*a*1, a second horizontal surface 218*a*2, and an intermediate slope surface 218*a*3 in a similar manner as the mirror member 18 of the first exemplary embodiment. However, a configuration of the third exemplary embodiment is different from that of the first exemplary embodiment in that a region of a rear slope surface 218*a*3B on a rear side of a valley line L2, which is a boundary between the second horizontal surface 218*a*2 and a front slope surface 218*a*3A, is also rounded.

More specifically, the rounded portion of the rear slope surface 218*a*3B on the rear side of the valley line L2 is formed such that a section thereof is constant along the entire length thereof, and is smoothly and continuously connected with a rounded portion of the rear slope surface 218*a*3*b* on a rear side of a ridge line L1. Accordingly, the rear slope surface 218*a*3B of the intermediate slope surface 218*a*3 is formed as a curved surface having an S-shaped section. The rear slope surface 218*a*3B extends on the opposing-lane side than the front slope surface 218*a*3A, and is smoothly connected to the second horizontal surface 218*a*2 at a right side end thereof In FIG. 9, the rear slope surface 218*a*3B is meshed in order to illustrate the shape of the wavy curved surface.

According to the configuration of the third exemplary embodiment, most of a light distribution pattern P3 formed by a light reflected by the intermediate slope surface 218*a*3 of the upwardly reflecting surface 218*a* can be formed so as to be smoothly connected to a light distribution pattern P1 formed by a light reflected by the first horizontal surface 218*a*1 as well as to a light distribution pattern P2 formed by a light reflected by the second horizontal surface 218*a*2.

A front end of the rounded portion of the rear slope surface 218*a*3B on the rear side of the valley line L2 is disposed about 1 mm to about 4 mm behind the rear focal point F. Thus, although there is a wall surface slightly extending upward from a front slope surface 218*a*3A near the valley line L2, an area around a front edge 218*b* of the upwardly reflecting surface 218*a* can still upwardly reflect light.

Consequently, while the cutoff lines CL1, CL2, CL3 are clearly formed by the front edge 218*b* of the upwardly reflecting surface 218*a*, it is possible to suppress the generation of a light distribution unevenness by reducing the brightness in an overlapping portion of the light distribution patterns P2 and P3.

While description has been made in connection with exemplary embodiments of the present invention, those skilled in the art will understand that various changes and modification may be made therein without departing from the present invention. For example, numerical values in the above description of the exemplary embodiments may, of course, be set to different values as is advantageous. It is aimed, therefore, to cover in the appended claims all such changes and modifications falling within the true spirit and scope of the present invention.

What is claimed is:

1. A lamp unit for a headlamp of a vehicle, the lamp unit comprising:

a projection lens disposed on an optical axis of the lamp unit;

a light emitting device disposed on a rear side of a rear focal point of the projection lens;

a reflector disposed so as to cover an upper side of the light emitting device; and a mirror member comprising an upwardly reflecting surface arranged between the reflector and the projection lens such that a front edge of the upwardly reflecting surface passes through the rear focal point of the projection lens, wherein the reflector forwardly reflects light from the light emitting device toward the optical axis, wherein the upwardly reflecting surface upwardly reflects part of the light reflected by the reflector, wherein the upwardly reflecting surface comprises:

a first horizontal surface disposed on a self-lane side of the optical axis;

a second horizontal surface disposed on an opposing-lane side of the optical axis, wherein the second horizontal surface is parallel to the first horizontal surface and lower than the first horizontal surface; and an intermediate slope surface connecting the first horizontal surface and the second horizontal surface, and wherein the intermediate slope surface comprises:

a front slope surface rearwardly extending from a portion of the front edge of the upwardly reflecting surface; and a rear slope surface rearwardly extending from a rear end of the front slope surface, wherein the rear slope surface is curved such that a virtual edge extending rearward from a boundary between the first horizontal surface and the front slope surface at the front edge of the intermediate slope surface is rounded.

2. The lamp unit according to claim 1, wherein the front slope surface is flat.

3. The lamp unit according to claim 1, wherein a width of the front slope surface in a direction orthogonal to the optical axis becomes gradually wider toward the rear slope surface.

4. The lamp unit according to claim 3, wherein the front slope surface and the rear slope surface are contiguously connected to each other.

5. The lamp unit according to claim 3, wherein the front slope surface is curved.

6. The lamp unit according to claim 1, wherein the rear slope surface comprises a cylindrical curved surface.

7. The lamp unit according to claim 1, wherein a boundary between the second horizontal surface and the rear slope surface is on the opposing-lane side than a boundary between the second horizontal surface and the front slope surface.

8. The lamp unit according to claim 7, wherein the second horizontal surface and the rear slope surface are smoothly connected.

9. The lamp unit according to claim 1, wherein an area of the rear slope surface is larger than an area of the front slope surface.

10. The lamp unit according to claim 1, wherein the rear slope surface is longer than the front slope surface in a direction parallel to the optical axis.

11. The lamp unit according to claim 1, wherein a boundary between the first horizontal surface and the rear slope surface is on the self-lane side than a boundary between the first horizontal surface and the front slope surface.

12. The lamp unit according to claim 1, wherein the first horizontal surface and the rear slope surface are smoothly connected.

13. The lamp unit according to claim 1, wherein the optical axis extends in a front-and-rear direction of the vehicle when the lamp unit is mounted on the vehicle.

14. The lamp unit according to claim 1, wherein a distance between the rear focal point of the projection lens and a front end of the rear slope surface is 1 mm to 4 mm.

15. The lamp unit according to claim 1, wherein the light emitting device is disposed on the optical axis, and is oriented such that a light emitting surface of the light emitting device faces upward.

16. A method of manufacturing a lamp unit for a headlamp of a vehicle, the method comprising:

disposing a projection lens on an optical axis of the lamp unit;

disposing a light emitting device on a rear side of a rear focal point of the projection lens;

disposing a reflector so as to cover an upper side of the light emitting device; and arranging a mirror member comprising an upwardly reflecting surface between the reflector and the projection lens such that a front edge of the upwardly reflecting surface passes through the rear focal point of the projection lens, wherein the reflector forwardly reflects light from the light emitting device toward the optical axis, wherein the upwardly reflecting surface upwardly reflects part of the light reflected by the reflector, wherein the upwardly reflecting surface comprises:

a first horizontal surface disposed on a self-lane side of the optical axis;

a second horizontal surface disposed on an opposing-lane side of the optical axis, wherein the second horizontal surface is parallel to the first horizontal surface and lower than the first horizontal surface; and an intermediate slope surface connecting the first horizontal surface and the second horizontal surface, and wherein the intermediate slope surface comprises:

a front slope surface rearwardly extending from a portion of the front edge of the upwardly reflecting surface; and a rear slope surface rearwardly extending from a rear end of the front slope surface, wherein the rear slope surface is curved such that a virtual edge extending rearward from a boundary between the first horizontal surface and the front slope surface at the front edge of the intermediate slope surface is rounded.

* * * * *